US011536042B2

(12) United States Patent
Häfner et al.

(10) Patent No.: US 11,536,042 B2
(45) Date of Patent: Dec. 27, 2022

(54) BOOM SYSTEM HAVING A RETRACTED POSITION WHICH REDUCES INSTALLATION SPACE

(71) Applicant: Putzmeister Engineering GmbH, Aichtal (DE)

(72) Inventors: Jens Häfner, Stuttgart (DE); Peter Mögle, Leinfelden-Echterdingen (DE); Ansgar Müller, Stuttgart (DE); Knut Kasten, Ostfildern (DE)

(73) Assignee: Putzmeister Engineering GmbH, Aichtal (DE)

( * ) Notice: Subject to any disclaimer, the term of this patent is extended or adjusted under 35 U.S.C. 154(b) by 662 days.

(21) Appl. No.: 16/491,940

(22) PCT Filed: Mar. 6, 2018

(86) PCT No.: PCT/EP2018/055420
§ 371 (c)(1),
(2) Date: Sep. 6, 2019

(87) PCT Pub. No.: WO2018/162453
PCT Pub. Date: Sep. 13, 2018

(65) Prior Publication Data

US 2020/0080325 A1 Mar. 12, 2020

(30) Foreign Application Priority Data

Mar. 7, 2017 (DE) ..... 10 2017 203 705.9

(51) Int. Cl.
*E04G 21/04* (2006.01)

(52) U.S. Cl.
CPC ..... *E04G 21/0445* (2013.01)

(58) Field of Classification Search
CPC . E04G 21/0445; E04G 21/0436; B66C 23/42; B66C 23/68
(Continued)

(56) References Cited

U.S. PATENT DOCUMENTS 4,150,754 A 4/1979 Schmitt
6,290,078 B1 9/2001 Verchere
(Continued)

FOREIGN PATENT DOCUMENTS

DE 2822110 A1 12/1978
DE 102008013990 A1 9/2009
(Continued)

OTHER PUBLICATIONS

International Search Report dated Apr. 20, 2018, for International Patent Application No. PCT/EP2018/055420.

*Primary Examiner* — Michael R Reid
(74) *Attorney, Agent, or Firm* — Alix, Yale & Ristas, LLP

(57) ABSTRACT

A boom system for a concrete-delivery device includes a plurality of booms which are pivotably interconnected. At least one of the booms has a recess along its length, the recess configured to at least partially receive an adjacent boom when the boom system. is in a retracted position. Side walls of the boom are extended to define the recess in the form of a channel. The recess may have a depth greater than or equal to a height of the adjacent boom so that the adjacent boom is received within the recess when the boom system is in the retracted position. Alternatively, the recess may have a depth less than a height of the adjacent boom so that the adjacent boom is only partially received in the recess when the boom system is in the retracted position.

17 Claims, 3 Drawing Sheets

(58) Field of Classification Search
USPC ..... 137/615
See application file for complete search history.

(56) References Cited

U.S. PATENT DOCUMENTS

| | | | | |
|---|---|---|---|---|
| 6,719,009 | B1 * | 4/2004 | Bissen et al. | E04G 21/0436 138/140 |
| 6,755,212 | B1 * | 6/2004 | Anderson et al. | F16L 57/06 428/36.1 |
| 6,786,233 | B1 | 9/2004 | Anderson et al. | |
| 7,111,745 | B2 * | 9/2006 | Nurse et al. | B66C 23/701 52/843 |
| 9,777,491 | B2 * | 10/2017 | Grivetti | E04G 21/0436 |
| 2004/0108003 | A1 * | 6/2004 | Schwing et al. | E04G 21/0418 137/615 |
| 2006/0032702 | A1 | 2/2006 | Linsmeier et al. | |

FOREIGN PATENT DOCUMENTS

| | | | |
|---|---|---|---|
| EP | 2039498 | A2 | 3/2009 |
| FR | 2546496 | A1 | 11/1984 |
| JP | 2010013880 | A | 1/2010 |
| KR | 1020100125942 | A | 12/2010 |
| WO | 8600279 | A1 | 1/1986 |

* cited by examiner

BOOM SYSTEM HAVING A RETRACTED POSITION WHICH REDUCES INSTALLATION SPACE

TECHNICAL FIELD

The present invention relates to a boom arm system, and in particular to a boom arm system for a (mobile) concrete delivery device.

DESCRIPTION OF THE PRIOR ART

As is known, concrete delivery devices comprise a boom arm system which is formed from a plurality of boom arms connected pivotably to one another and in which the individual boom arms come to lie on one another in the folded-in state. The aim here is for the boom arms in their folded-in position to require as little space as possible and for the concrete delivery device to therefore have an overall height which is as low as possible and is in accordance with traffic regulations (cf., for example, DE 10 2008 013 990 A1).

SUMMARY OF THE INVENTION

Proceeding therefrom, a concrete delivery device having the features of claim 1 is proposed according to the invention.

The basic concept of the invention consists in inserting one boom arm in the folded-in position into a recess formed in another, for example adjacently lying boom arm, in order to reduce the overall height. The clear size of the recess is somewhat wider than the width of the boom arm to be inserted into the recess.

This makes it possible to save construction space and a design of the folded arm package that is more effective in terms of construction space is made possible. Since the geometrical moment of inertia and the moment of resistance depend primarily on the height of the girder forming the boom arm, the arms can thus be designed to be lighter while having the same load-bearing capacity.

For the configuration according to the invention of a boom arm system, boom arms manufactured in particular from composite material are appropriate. Typical composite materials are, for example, carbon-fibre-reinforced plastics which are also known by the abbreviation CFRP (carbon-fibre-reinforced plastic). It is in principle also possible to realize the boom arm system according to the invention with boom arms made from steel, but steel has rather a tendency to be geometrically unstable while higher wall thicknesses (with the same or lower weight) can be realized with CFRP structures. In addition, sandwich structures can be constructed relatively simply. It is also possible in the case of CFRP boom arms to adapt the wall thicknesses of the girder to the loading; for example, the limbs (side walls) can be designed to be more solid than the rest of the arm. Suitable composite materials include in particular (but not exclusively) fibre composite materials, such as the CFRP already mentioned, or else containing basalt fibres, aramid fibres, glass fibres or the like.

The boom arm system can comprise boom arms composed of steel and boom arms composed of composite material or else of a composite mix (such as, for example, upper side of steel and the lower side of fibre composite material), or all of the boom arms can be made from composite material.

The recess can extend substantially over the entire length of the other boom arm. Accordingly, the boom arm can be inserted into the other boom arm over substantially the entire length of the boom arm, for example with the swivel joint arrangements being left free. The boom arm can be inserted over part of its height or substantially the entire height. If two adjacent boom arms have recesses according to the invention, the boom arm can in each case lie proportionally with part of its height in the two recesses in such a manner that it is substantially completely accommodated by the two recesses.

Further advantages and refinements of the invention emerge from the dependent claims, the description and the attached drawing.

It goes without saying that the features mentioned above and those which have yet to be explained below can be used not only in the respectively stated combination, but also in other combinations or on their own without departing from the scope of the present invention.

The invention is illustrated schematically in the drawing with reference to an exemplary embodiment and will be described in detail below with reference to the drawing.

DETAILED DESCRIPTION

Identical and similar features illustrated in the individual figures are denoted by the same reference signs.

Figure 1:
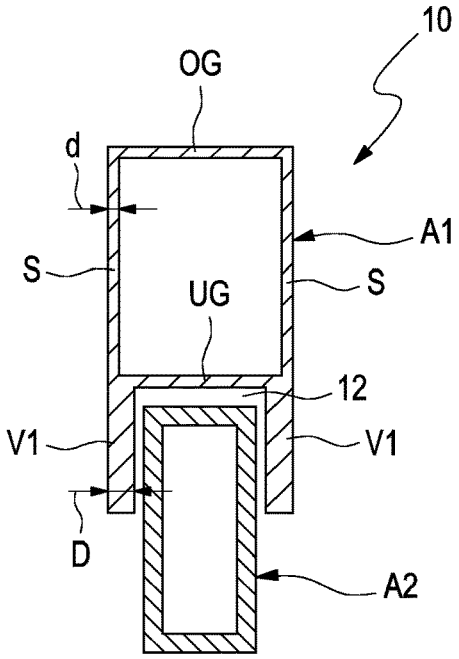
FIG. 1, as a cutout from a boom arm system according to the invention, shows two adjacent boom arms in the folded-in position in cross section.

FIG. 1, as a cutout from a boom arm system 10 according to the invention, shows two adjacent boom arms A1, A2 in the folded-in position in cross section. In the present context, "adjacent" should be understood as meaning two boom arms which come to lie with respect to each other in the folded-in position of the boom in such a manner that they run at least in sections parallel to each other lying one above the other and can thus engage using the inventive concept of one of the arms in a recess of the other arm. This does not inevitably mean that the two relevant boom arms have to be coupled directly to each other.

In the folded-in position illustrated, the two boom arms A1, A2 lie one above the other, as is the case in many folded-in positions. The boom arm A1 lying at the top in the illustration of FIG. 1 (accommodating boom arm) has a somewhat wider cross section than the boom arm A2 lying therebelow (boom arm to be accommodated). In addition, the upper boom arm A1 has a recess 12. The recess 12 extends in the longitudinal direction along the boom arm A1. The recess 12 extends, for example, substantially over the entire length of the boom arm A1. The recess 12 can be designed in the form of a channel having a depth. The recess generally extends between the joint regions of the boom arm and leaves the joint regions free.

In the exemplary embodiment illustrated, the recess 12 is formed on a lower wall UG of the upper boom arm A1. For example, the recess 12 can be formed by extenders of left and right side walls S of the boom arm A1. The side walls S project here beyond the lower wall UG in such a manner that the resultantly formed extensions V1 form the recess 12 having a depth for accommodating some or all of the cross sectional height of the adjacent boom arm A2. Alternatively, the extensions V1 and the boom arm A1 can also be formed by placing two U profiles on each other. Possible production variants are readily revealed to a person skilled in the art.

The clear width of the recess 12, i.e. the distance between the two extensions V1, is somewhat wider than the cross section of the lower boom arm A2, and therefore the latter in the folded-in position of the boom arms A1, A2 is accommodated in the recess 12.

In the exemplary embodiment illustrated, the extensions V1 of the upper boom arm A1 protrude over the height of the lower boom arm A2 approximately by up to half thereof. The lower boom arm A2 is therefore partially accommodated in the recess 12 lying thereabove. However, the dimensions of the recess and of the boom arms can also be selected in such a manner that the lower boom arm is accommodated in terms of height substantially completely or completely in the recess, as is indicated in the exemplary embodiment of FIG. 3.

It should be emphasized that the illustrated and described arrangement is also reversible, and therefore the lower boom arm has a recess, which is formed on the upper wall thereof, for accommodating the cross-sectionally narrower boom arm lying thereabove.

Figure 2:
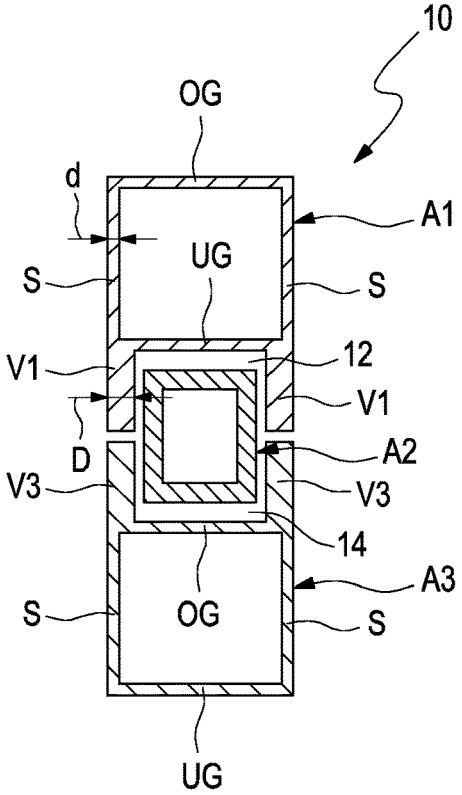
FIG. 2, as a cutout from a variant embodiment of a boom arm system according to the invention, shows three adjacent boom arms in the folded-in position in cross section.

A combination is also possible, as is illustrated in the exemplary embodiment of FIG. 2. FIG. 2 shows an arrangement similar to the illustration of FIG. 1 with an additional boom arm A3 which, in the folded-in position, comes to lie below the hitherto lower boom arm A2. As already described, a recess 14 according to the invention with extensions V3 of the side walls S is formed on an upper wall OG of the lowermost boom arm A3, said recess serving to accommodate the (now middle) boom arm A2 lying thereabove. The two recesses 12, 14 are designed in such a manner that the middle boom arm A2 comes to lie both approximately half in the upper recess 12 and also approximately half in the lower recess 14 and is therefore substantially completely surrounded by the recesses. Different divisions than the illustrated division substantially in half are also possible.

Figure 3:
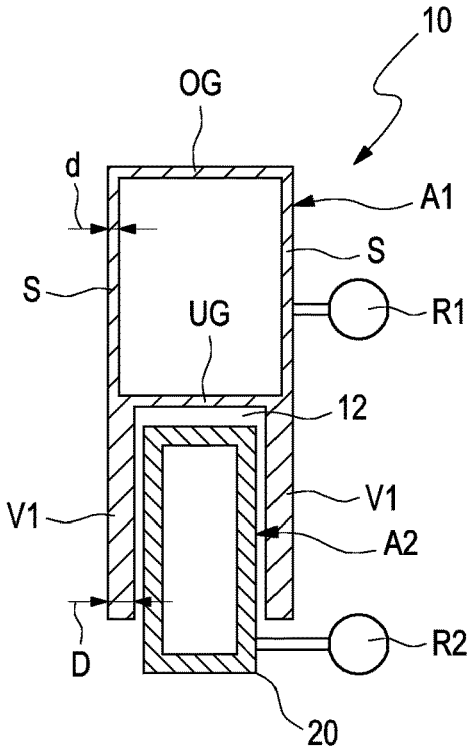
FIG. 3 shows boom arms similarly to the variant embodiment of FIG. 1 with pipe holders.
Figure 4:
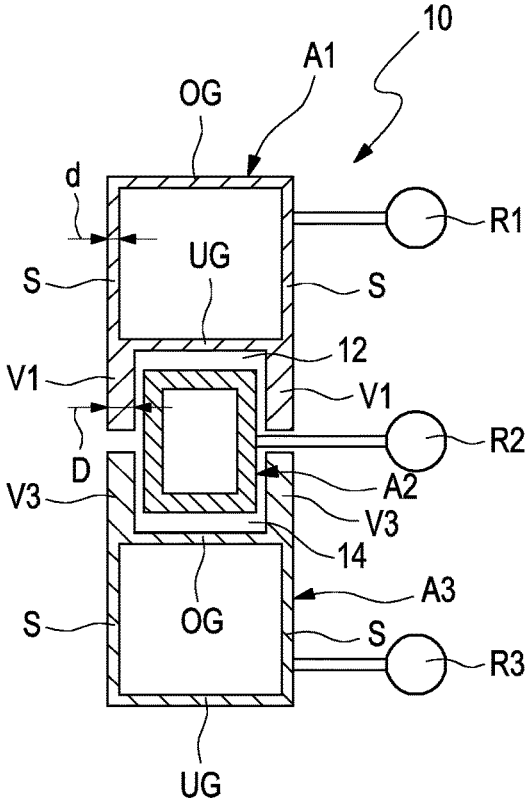
FIG. 4 shows boom arms similarly to the variant embodiment of FIG. 2 with pipe holders.

FIGS. 3 and 4 show illustrations of the boom arm system with pipe holders R1, R2, R3 on the boom arms A1, A2 and A3. The pipe holders R1, R3 on the boom arms A1, A3 with a recess 12, 14 are attached or fastened as conventional per se to a side wall S of the relevant boom arm. The arrangement can take place, for example, centrally with respect to the height of the hollow profile of the arm (cf. pipe holder R1 of FIG. 3). However, it may also be expedient not to attach the pipe holders and therefore the delivery lines for the concrete in the region of the rigid fibres of the profile (the rigid fibre is located in the centre of the profile); such arrangements are illustrated for the pipe holders R1, R3 in FIG. 4.

The pipe holders R2 of the boom arm A2 which comes to lie in one or both of the recesses 12, 14 of the adjacent boom arms A1, A3 are positioned in such a manner that they project out of the recess 12, 14. This takes place, for example, by arranging the pipe holder R2 in the region of an end or an edge 20 of the boom arm A2 that lies outside the relevant recess 12 (cf. FIG. 3). Optionally, a groove (not illustrated specifically) can be provided on the extension V1 of the accommodating boom arm A1 so that the pipe holder in the folded-in position does not act upon or touch the extension. A configuration with such a groove is illustrated below with reference to FIGS. 7 and 8.

Alternatively, the pipe holder—as illustrated in FIG. 4 and already mentioned above—can be arranged approximately centrally on the boom arm A2 and can thus project between the two extensions V1, V3 of the upper and lower recess 12, 14. It is important that folding in and unfolding of the boom arms is not impaired by the arrangement of the pipe holders.

Figure 5:
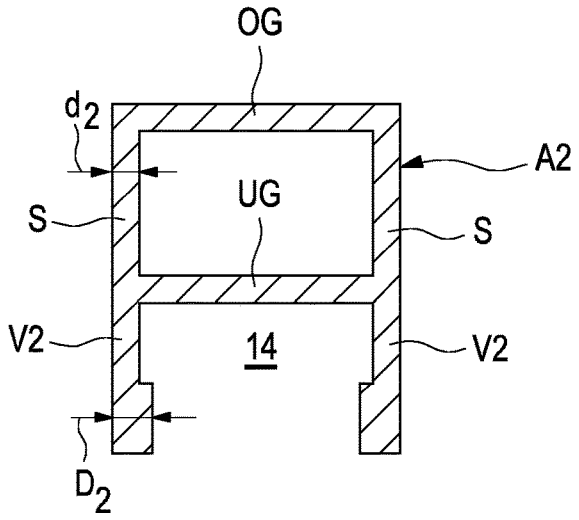
FIG. 5 shows a variant of the first boom arm of FIG. 1.

The described extensions on the hollow profiles of the accommodating boom arms contribute to the rigidity of the boom arm construction. In addition, the described extensions can (at least partially) have a greater wall thickness D than the wall thickness d of the side walls S of the accommodating boom arms A1, A3, as is indicated in the figures. The contribution made by the extensions to the rigidity is thereby improved. The formation of greater wall thicknesses on the extensions can be configured in a simple manner in particular when an accommodating boom arm is produced by joining two U profiles to each other. Particularly in one refinement, variable wall thicknesses can readily be realized by means of CFRP. FIG. 5 shows as a variant a refinement in which a first portion (adjacent to the hollow profile) of the extension V2 substantially has the same wall thickness d2 as the side wall S of the hollow profile, while a second portion of the extension which is further away has a greater wall thickness D2. Also in this embodiment, the extensions V2 of the recess 14 have a thicker wall thickness D2 than the wall thickness d2 of the side walls S of the hollow profile.

Figure 6:
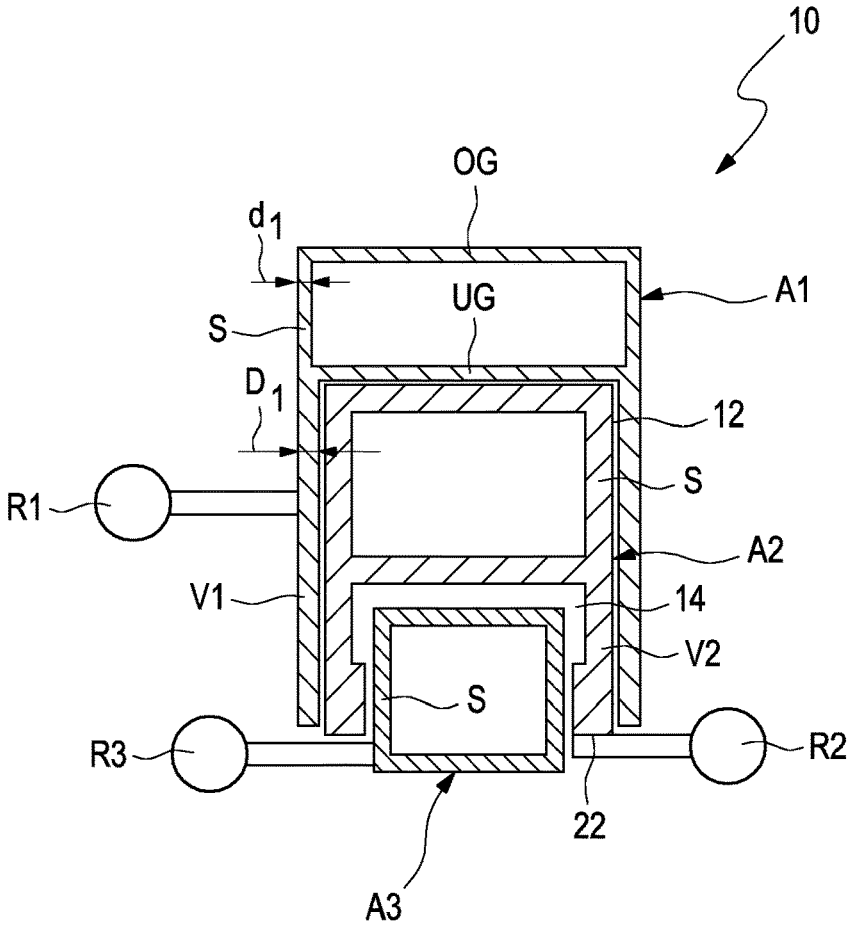
FIG. 6, as a cutout from a further variant embodiment of a boom arm system according to the invention, shows three adjacent boom arms in the folded-in position in cross section with pipe holders.

FIG. 6 shows a variant of a boom arm system according to the invention with pipe holders R1, R2, R3, using the boom arm A2 of FIG. 5. The variant of FIG. 6 comprises three boom arms A1, A2, A3 having a successively smaller or narrower cross section in such a manner that a recess 12 of the first boom arm A1 substantially completely accommodates the second boom arm A2 lying adjacent (in the folded-in position), and the recess 14 of the latter in turn substantially completely accommodates the third boom arm A3 lying adjacent (in the folded-in position). The respectively inner boom arms A2, A3 protrude beyond the recess only at the end of the corresponding accommodating recess 12 or 14 remote from the hollow profile to such an extent that another pipe holder R2, R3, which is attached to the boom arm A2, A3, runs outside the recess, as has already been explained above.

The first boom arm A1 has a side wall thickness dl on its hollow profile while the extensions V1 forming the recess 12 of the first boom arm A1 have (continuously) a thicker wall thickness D1. The wall thickness ratios of the second boom arm A2 have already been described above with reference to FIG. 5.

The pipe holders R1 and R3 of the first and the third boom arm A1 and A3 are arranged similarly as in the refinements of FIGS. 2 to 4 on an outer side of the side wall of the extension V1 (in the case of the first arm A1) or the side wall S of the hollow profile (in the case of the third arm A3). In the case of the second arm A2, the pipe holder R2 is not arranged on an outer side of the extension V2, but rather on the end side 22 thereof which is remote from the hollow profile. This refinement permits particularly compact packing/nesting.

Figure 7:
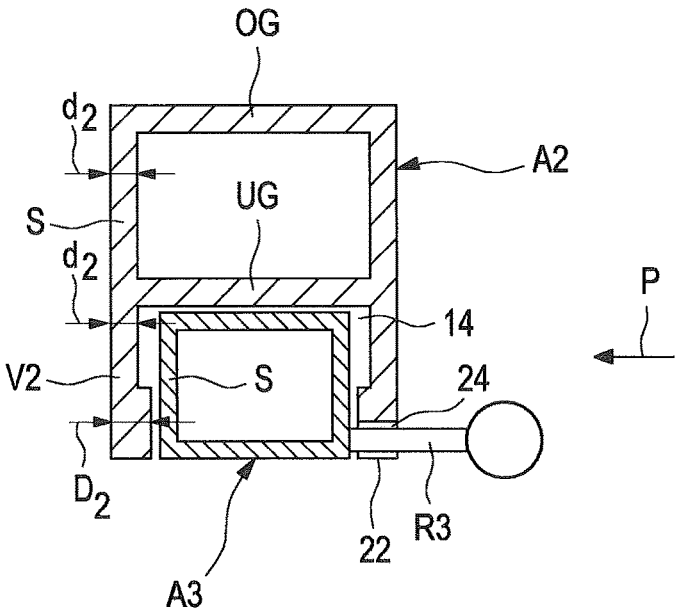
FIG. 7 shows the boom arm of FIG. 5 in a sectional illustration having a further boom arm which is accommodated in the recess of the boom arm and the pipe holder of which projects through a groove.
Figure 8:
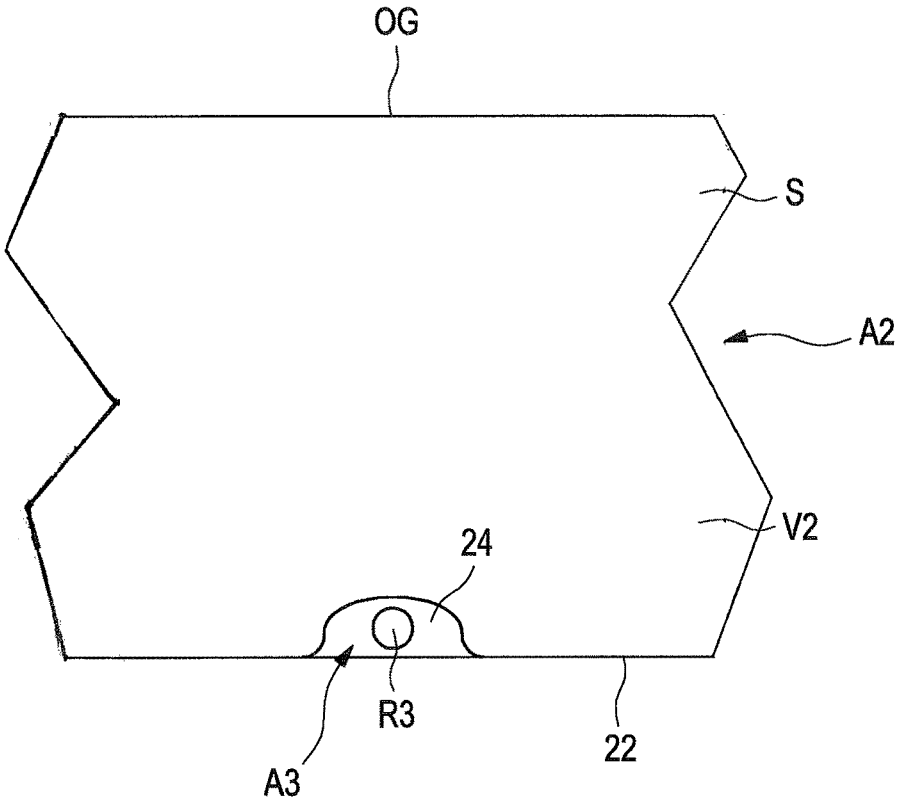
FIG. 8 shows the situation of FIG. 7 in a lateral view in the direction of view of the arrow P.

FIGS. 7 and 8 show a further refinement according to the invention for illustrating the described grooves.

FIG. 7 shows the boom arm A2 of FIG. 5 with a further boom arm A3, which is accommodated in the recess 14, in the folded-in position, and FIG. 8 shows the boom arm A2 in a lateral view looking in the direction of the arrow P of FIG. 7. The inner boom arm A3 has a pipe holder R3 which is fastened to a lower region (in the illustration of FIG. 7) of the side wall S of the boom arm A3. The accommodating boom arm A2 has a groove (or clearance) 24 on its extension V2 and in particular on its end side 22 remote from the hollow profile. In the folded-in position illustrated, the pipeline R3 of the inner boom arm R3 projects as illustrated through the groove 24. This results in a particularly compact arrangement in the folded-in position of the boom arm system.

The invention provides a boom arm system for a concrete delivery device which is formed from a plurality of boom arms connected pivotably to one another, wherein one boom arm is inserted into a recess formed in an adjacently lying boom arm in order to reduce the overall height in the folded-in position. The insertion takes place over substantially the entire length of the arm. The invention makes it possible for the construction space of a concrete pump to be used more effectively, and therefore lighter and stiffer arms can be constructed.

The invention claimed is:

1. A boom arm system for a concrete delivery device, where said boom arm system is formed from a plurality of boom arms connected pivotably to one another and of which at least one boom arm in longitudinal extent has a recess which is configured in such a manner that, in a folded-in position of the boom arm system, said recess serves for accommodating an adjacently arranged boom arm having a narrower cross section, wherein the at least one boom arm comprises a pipe holder that projects out and the boom arm having a narrower cross section has a pipe holder that projects out of said recess in the folded-in position of the boom arm system.

2. The boom arm system of claim 1, wherein the recess is formed on an upper chord or lower chord of the at least one boom arm.

3. The boom arm system of claim 2, wherein the recess along the at least one boom arm is defined between side walls of the at least one boom arm and the side walls extend beyond the upper chord or the lower chord.

4. The boom arm system of claim 2, wherein the recess is defined by a cross section shape of the upper chord or lower chord.

5. The boom arm system of claim 1 wherein the recess extends over a length of the at least one boom arm.

6. The boom arm system of claim 1 wherein the boom arm having a narrower cross section has a height, the recess has a depth equal to or greater than said height, and the recess completely accommodates the boom arm having a narrower cross section.

7. The boom arm system of claim 1, wherein the boom arm having a narrower cross section has a height, the recess has a depth less than the height and the recess partially accommodates the boom arm having a narrower cross section.

8. The boom arm system of claim 7, wherein, in the folded-in position, the boom arm having a narrower cross section has a first portion that extends into the recess in a second portion that extends into another recess of a second adjacent boom arm of said plurality of boom arms.

9. The boom arm system of claim 8, wherein the boom arm having a narrower cross section is substantially completely accommodated by the recess and other recess.

10. The boom arm system of claim 1, wherein at least one of the plurality of boom arms is at least partially formed from either a composite material or a fiber composite material.

11. The boom arm system of claim 1, wherein side walls that define the recess have a thicker wall thickness (D) than a wall thickness (d) of side surfaces (S) of profiles of the plurality of boom.

12. The boom arm system of claim 1, wherein the recess is defined by side walls and one side wall of the recess has a groove configured to accommodate one of the pipe holders in the folded-in position whereby the one of the pipe holder in the folded-in position does not act upon or touch the one side wall.

13. The boom arm system of claim 1, wherein at least one of the pipe holders are arranged in such a manner that the at least one pipe holder comes to lie in the folded-in position at an end of the recess.

14. A concrete delivery device having a boom arm system according to claim 1.

15. The boom arm system of claim 1, wherein each the plurality of boom arms has axial ends adapted to include a joint region.

16. A boom arm system for a concrete delivery device, said boom system comprising:

a first boom having a hollow cross section and a recess;

a second boom having a hollow cross section, a pipe holder, and being pivotally connected to the first boom;

a third boom having a hollow cross section and a recess and being pivotably connected to the second boom; and at least one of the first and third booms comprising a pipe holder, wherein, in a folded-in position of the boom arm system, the second boom has respective portions that extend into the recesses of the first and third booms and the pipe holder of the second boom either projects out of one of the recesses or is adjacent an end of one of the recesses.

17. A boom arm system for a concrete delivery device, said boom system comprising:

a first boom having a hollow cross section, a recess and a pipe holder;

a second boom having a hollow cross section, a pipe holder, a recess and being pivotally connected to the first boom; and a third boom having a hollow cross section and a pipe holder, and being pivotably connected to the second boom, wherein, in a folded-in position of the boom arm system, the second boom extends into the recess of the first boom and the third boom extends into the recess of the second boom, wherein the pipe holder of the second boom either projects out of the recess of the first boom or is adjacent an end of the recess of the first boom, and wherein the pipe holder of the third boom either projects out of the recess of the second boom or is adjacent an end of the recess of the second boom.

* * * * *